US007789049B2

(12) United States Patent
Duley

(10) Patent No.: US 7,789,049 B2
(45) Date of Patent: Sep. 7, 2010

(54) VARIABLE CAPACITY WATER PUMP VIA ELECTROMAGNETIC CONTROL

(75) Inventor: William Robert Duley, Bellefontaine, OH (US)

(73) Assignee: Honda Motor Co., Ltd., Tokyo (JP)

( * ) Notice: Subject to any disclaimer, the term of this patent is extended or adjusted under 35 U.S.C. 154(b) by 246 days.

(21) Appl. No.: 12/172,660

(22) Filed: Jul. 14, 2008

(65) Prior Publication Data

US 2010/0006044 A1 Jan. 14, 2010

(51) Int. Cl.
*F01P 5/10* (2006.01)

(52) U.S. Cl. ..... 123/41.47; 123/41.44

(58) Field of Classification Search ..... 123/41.02, 123/41.44, 41.47

See application file for complete search history.

(56) References Cited

U.S. PATENT DOCUMENTS

| | | | |
|---|---|---|---|
| 3,019,875 | A | 2/1962 | Fowler |
| RE30,428 | E | 11/1980 | Detty |
| 4,278,159 | A | 7/1981 | Roth et al. |
| 4,381,174 | A | 4/1983 | Obler |
| RE31,947 | E | 7/1985 | Farr |
| 5,152,383 | A | 10/1992 | Boyer et al. |
| 5,169,286 | A | 12/1992 | Yamada |
| 5,431,340 | A | 7/1995 | Schirpke et al. |
| 6,007,303 | A | 12/1999 | Schmidt |
| 6,481,390 | B1 | 11/2002 | Robb |
| 6,644,933 | B2 | 11/2003 | Light et al. |
| 6,669,439 | B2 | 12/2003 | Kardasz et al. |
| 6,746,206 | B2 | 6/2004 | Madsen et al. |
| 6,796,766 | B2 | 9/2004 | Hesse |
| 7,186,071 | B2 | 3/2007 | Pascoe |
| 7,311,624 | B2 | 12/2007 | Lee |
| 2004/0103862 | A1 | 6/2004 | Aidnik |
| 2006/0066168 | A1 | 3/2006 | Shoykhet |

FOREIGN PATENT DOCUMENTS

JP 2009185726 A * 8/2009

* cited by examiner

*Primary Examiner*—Noah Kamen
(74) *Attorney, Agent, or Firm*—Rankin Hill & Clark, LLP

(57) ABSTRACT

A variable flow coolant pump for an engine of a motor vehicle comprises a pump housing defining a fluid chamber. The fluid chamber includes a fluid inlet and a fluid outlet for providing flow of coolant through the housing. An impeller is rotationally supported in the fluid chamber between the inlet and the outlet for pumping coolant through the housing. An engine driven shaft is disposed within the housing for supporting the impeller and rotating the impeller about a longitudinal axis. An electromagnetic field generator selectively produces a magnetic field that moves the impeller axially along the shaft between a first position and a second position which selectively changes the amount of coolant flow through the housing between the fluid inlet and the fluid outlet.

21 Claims, 5 Drawing Sheets

VARIABLE CAPACITY WATER PUMP VIA ELECTROMAGNETIC CONTROL

BACKGROUND

The present disclosure generally relates to water pumps for vehicles. More specifically, the present disclosure relates to a variable capacity water pump having an electromagnetic control.

Water pumps are typically used on vehicles today to provide heat transfer means for an engine during operation. The engine crank shaft typically drives the water pump at a fixed ratio. Thus, as the engine idle speed is reduced, a trend in vehicles today to reduce emissions, the water pump speed is correspondingly reduced. This reduction in water pump speed results in a reduction of the coolant flow through the cooling system which can result in poor heater output for the interior of the vehicle when needed in cold weather and also can result in poor coolant flow for engine cooling during hot weather.

Increasing the water pump speed by increasing the drive ratio from the crank shaft will increase the coolant flow at engine idle speeds, but it may result in over speeding the water pump at higher engine speeds which may produce pump cavitations and reduced water pump bearing life. Pump cavitations can result in pump damage and a reduction in cooling system performance.

It is known to add an auxiliary water pump, typically electrically driven, to provide additional coolant at low engine idle speeds. Another approach is to use movable vanes in the inlet of the water pump to throttle the coolant flow at higher engine speeds. However, the prior art systems have numerous disadvantages. For example, the auxiliary water pump and electrically driven water pump can add weight and cost because extra components are required, and because the capacity of the battery and generator needs to be increased, to supply the extra power needed by the water pump motor.

The present disclosure provides a variable capacity water pump having good coolant flow at low engine idle speeds while avoiding pump cavitation at higher engine speeds and without the need for an auxiliary water pump.

BRIEF DESCRIPTION

In accordance with one aspect, a variable flow coolant pump for an engine of a motor vehicle comprises a pump housing defining a fluid chamber. The fluid chamber includes a fluid inlet and a fluid outlet for providing flow of coolant through the housing. An impeller is rotationally supported in the fluid chamber between the inlet and the outlet for pumping coolant through the housing. An engine driven shaft is disposed within the housing for supporting the impeller and rotating the impeller about a longitudinal axis. An electromagnetic field generator selectively produces a magnetic field that moves the impeller axially along the shaft between a first position and a second position which selectively changes the amount of coolant flow through the housing between the fluid inlet and the fluid outlet.

In accordance with another aspect, a water pump for use in a coolant system to cool an engine comprises a housing defining a fluid chamber having a fluid inlet and a fluid outlet. A drive shaft has a first end section connected to an engine driven water pump pulley and a second end section. The drive shaft rotates at a rate proportional to a given engine speed. An impeller is disposed within the fluid chamber and coupled to the second end section of the drive shaft. The impeller pumps coolant through the housing and to the engine when rotated.

An electromagnetic field generator is operatively engaged to the drive shaft. The electromagnetic field generator produces a magnetic field that moves the impeller away from the fluid inlet toward the electromagnetic field generator to selectively change the amount of coolant flow through the fluid chamber.

In accordance with yet another aspect, a method for controlling the flow rate of engine coolant through a cooling system is provided. A water pump is provided, which includes a housing defining a fluid chamber, an impeller disposed within the fluid chamber, and an engine driven drive shaft extending axially through the water pump for rotating the impeller at a rate proportional to a given engine speed. An electromagnetic field generator is coupled to the water pump. The electromagnetic field generator includes an annular stator having a first set of electrically interconnected conductors and a rotor having a second set of electrically interconnected conductors. An electric current is introduced to the electromagnetic field generator to generate a magnetic field. The amount of electrical current introduced to the electromagnetic field generator is a function of the given engine speed to control the intensity and timing of the magnetic field. The magnetic field is introduced within the water pump. The impeller moves toward the magnetic field to selectively change the amount of coolant flow through the water pump at the given engine speed.

DETAILED DESCRIPTION

Figure 1:
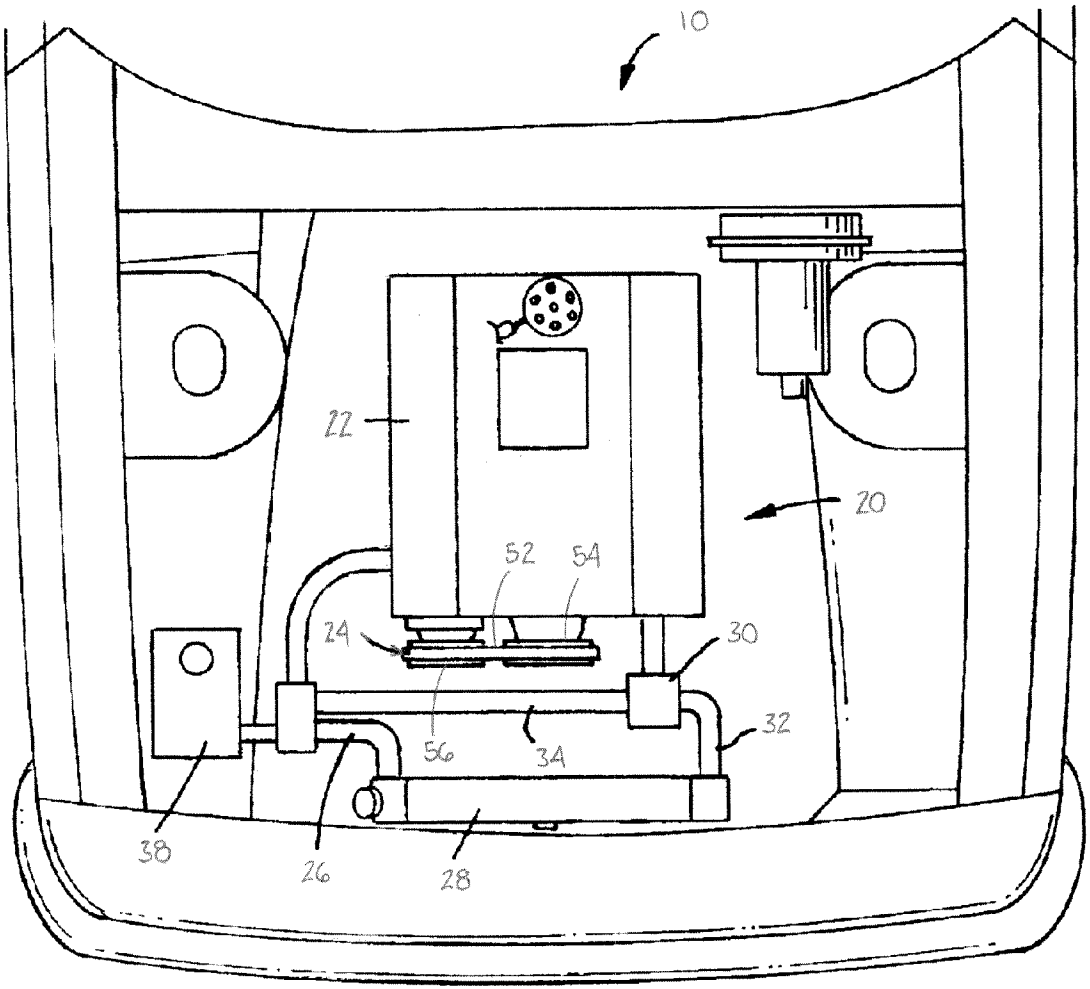
FIGURE 1 (PRIOR ART)
FIG. 1 is a schematic of a cooling system having a conventional fixed ratio water pump.

It should, of course, be understood that the description and drawings herein are merely illustrative and that various modifications and changes can be made in the structures disclosed without departing from the present disclosure. It will also be appreciated that the various identified components of the variable capacity water pump disclosed herein are merely terms of art that may vary from one manufacturer to another and should not be deemed to limit the present disclosure. It will be understood that, as used herein, the term "coolant" is used interchangeably as engine coolant, such as antifreeze, or water. All references to direction and position, unless otherwise indicated, refer to the orientation of the variable capacity water pump illustrated in the drawings and should not be construed as limiting the claims appended hereto.

Figure 2:
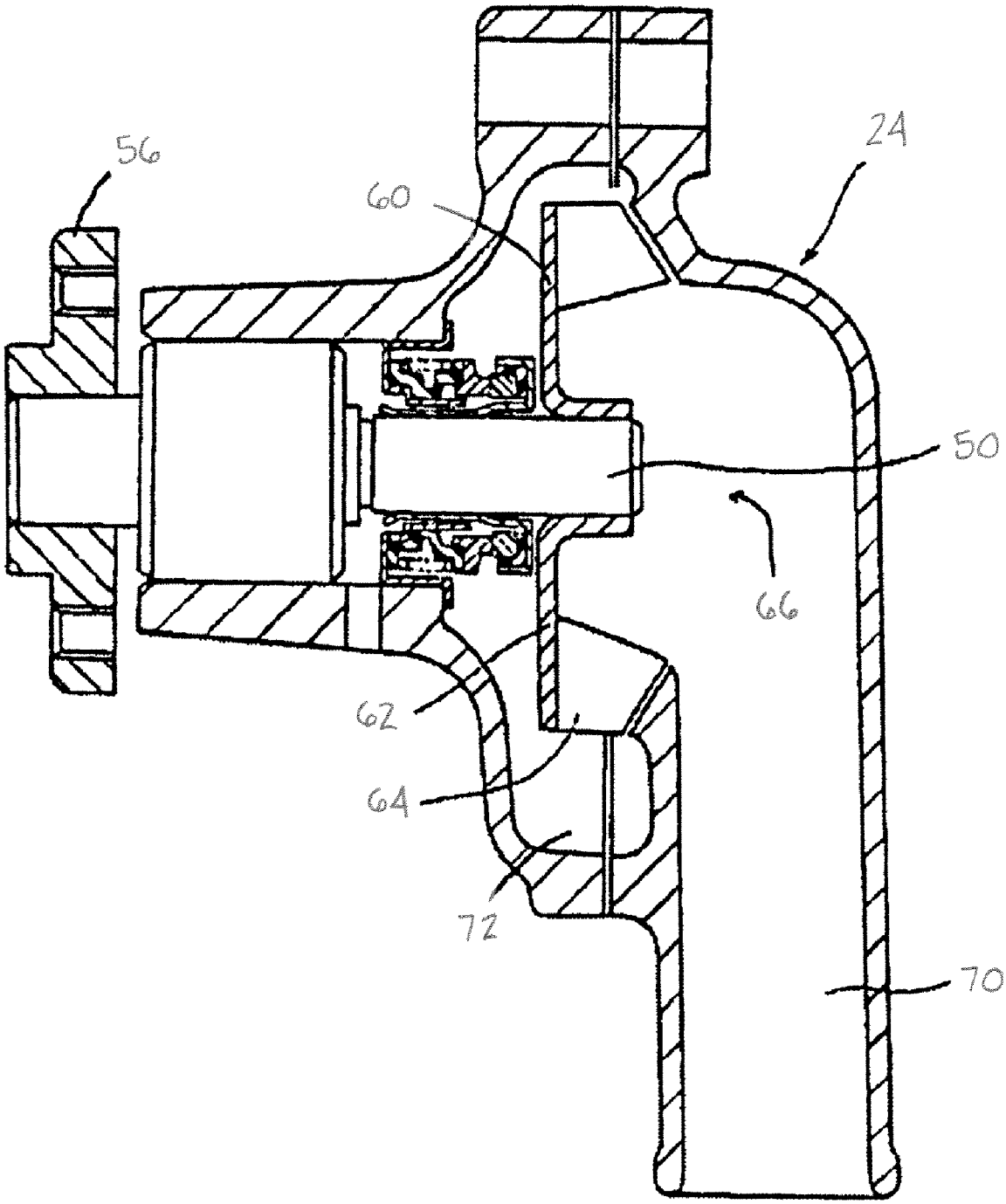
FIGURE 2 (PRIOR ART)
FIG. 2 is a cross-sectional view of the prior art fixed ratio water pump.

Referring now to FIGS. 1 and 2, a typical cooling system 20 for an internal combustion engine 22 according to the prior art uses a water pump 24 to control engine temperature of a vehicle 10. When the internal combustion engine 22 is started, coolant enters the water pump 24 through a branch duct 26 from a radiator 28. Coolant is then pumped out of the water pump 24 and into the cooling passages (not shown) of the engine 22. The coolant flows through the engine 22 to a thermostatic flow control valve 30. Coolant will then flow back to the radiator 28 through a supply duct 32 or be bypassed through a bypass duct 34 depending upon the engine coolant temperature as determined by the thermostatic control valve 30. When the engine is cool, the thermostatic flow control valve 30 directs the coolant through the bypass duct 34. If the engine is warm, the thermostatic flow control valve 30 directs the coolant through the supply duct 32 to the radiator 28, where the coolant is cooled. A coolant overflow area 38 is typically coupled to the branch duct 26.

Regarding operation of the water pump 24, the most common arrangement utilizes the engine rotation to drive a shaft 50 via a belt 52. The belt is connected between a driving pulley 54 (connected to a crankshaft (not shown) of the engine 22) and a driven pulley 56. The water pump 24 includes an impeller 60 secured to the shaft 50 for co-rotation therewith. The shaft 50 is driven by the pulley 56. The impeller 60 includes a flange 62 having several integral blades or vanes 64 projecting axially toward an inlet path 66. When the pulley 56 rotates, the drive shaft 50 rotates, and the vanes 64 similarly rotate. Coolant enters a passageway 70 and is thrown outward by centrifugal force of the rotating impeller 60 to an outlet port (not shown) via the outlet path 72.

One problem with the currently available engine driven water pumps 24 is that the speed of rotation of the water pump is, at all times, tied to the speed of the engine 22. As such, during engine idle modes, when the speed of the engine is low, the flow rate of coolant through the system 20 is correspondingly low. As engine idle speeds are lowered further for emissions purposes, this flow rate will correspondingly decrease. Further, as the speed of the engine 22 increases, such as those experienced under normal highway driving conditions, the rotational speed of the water pump 24 correspondingly increases. At these higher rates of rotational speed, water pump cavitation may occur, wherein the amount of coolant that is capable of being pumped through the water pump cannot keep up with the rotational speed of the impeller 60. This can create a vacuum within the water pump and may lead to pump damage. This can also lead to poor cooling efficiencies and increased power losses. Finally, during normal operating conditions, this higher rotational speed typically is not needed to maintain the engine within acceptable temperature ranges, thus the excess rotational speed is not necessary for optimal operation of the engine and coolant system. Further, the excess torque created can have an adverse effect on fuel economy and emissions.

Figure 3:
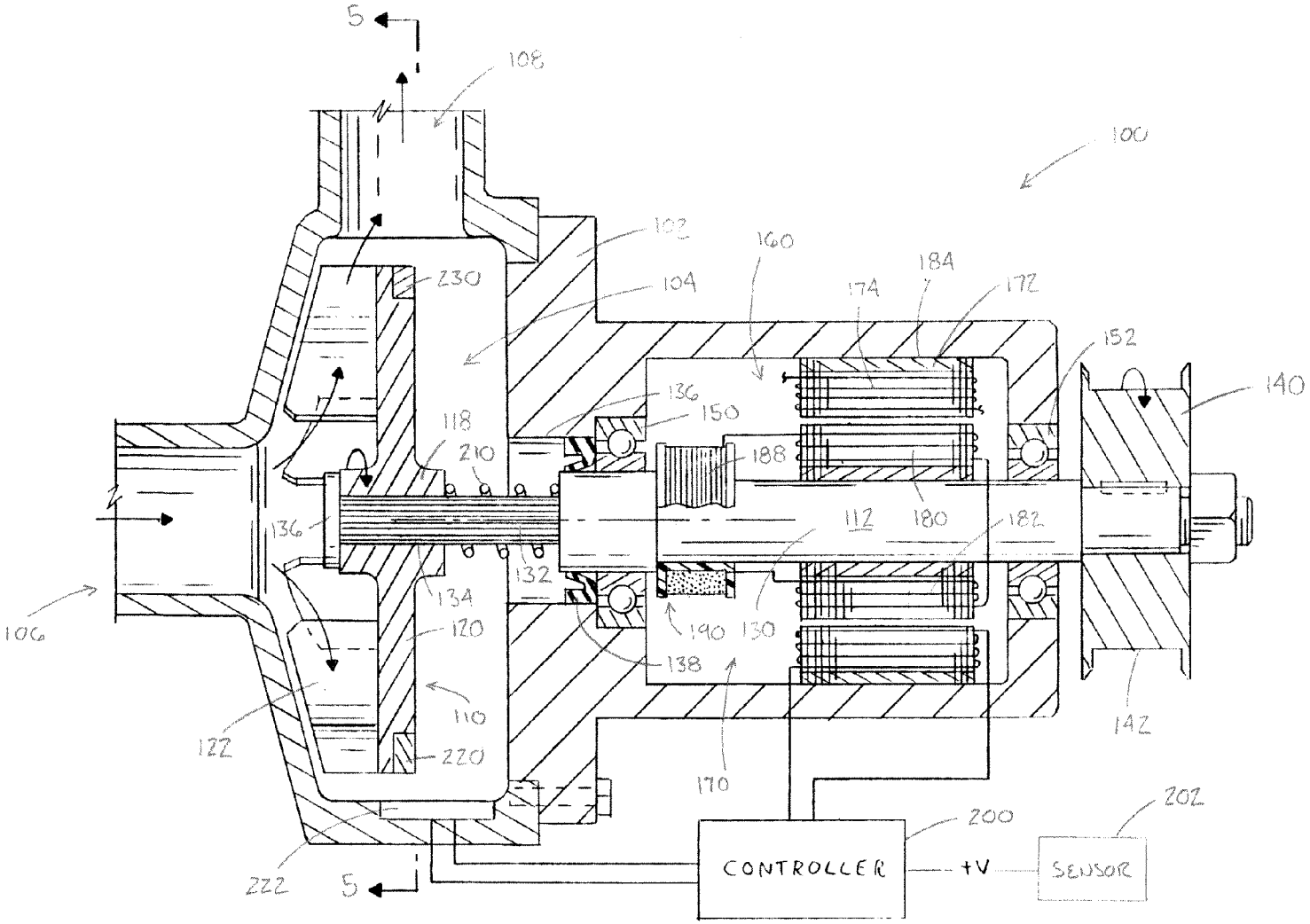
FIG. 3 is a cross-sectional view of a variable capacity water pump shown in a first position according to the present disclosure.
Figure 4:
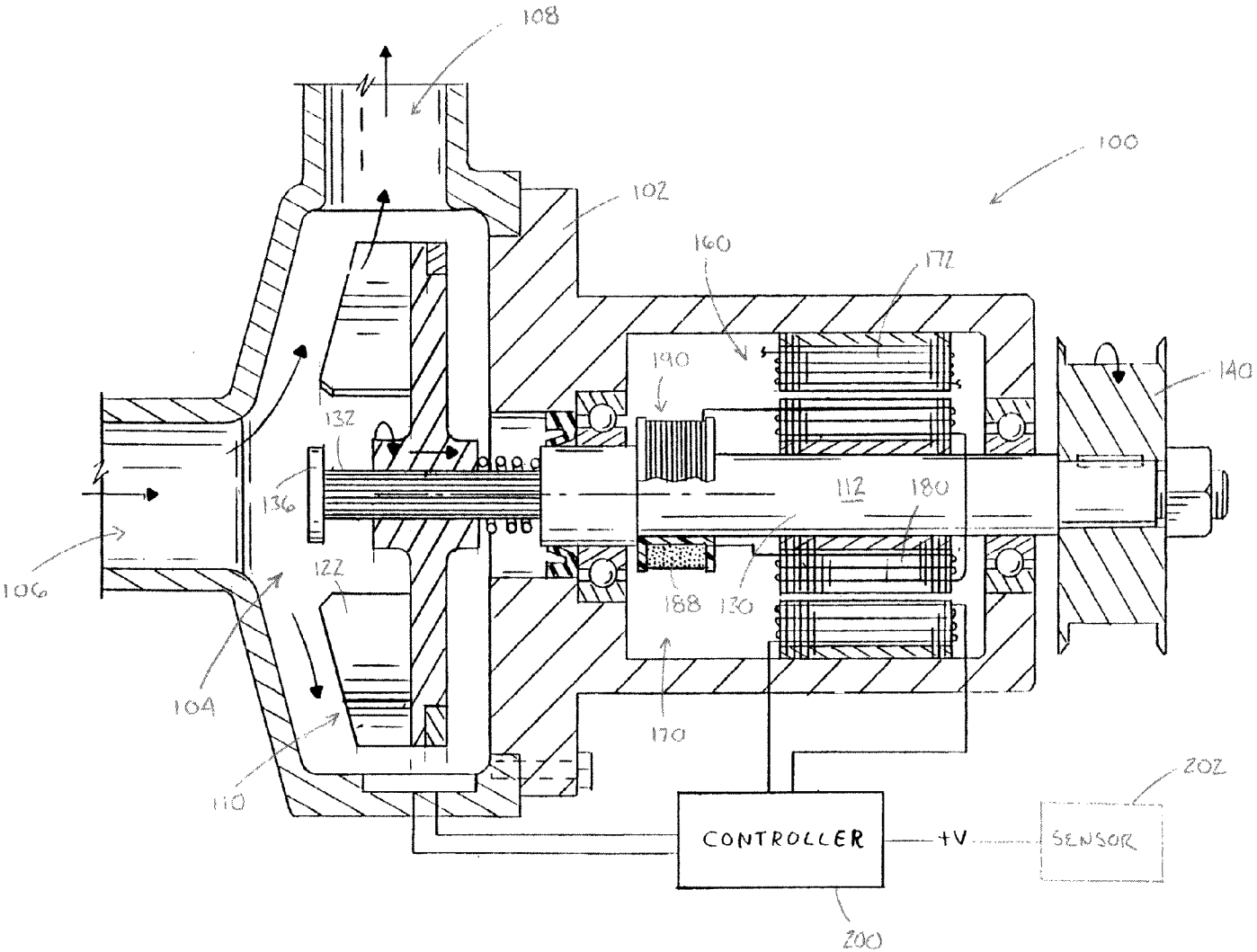
FIG. 4 is a cross-sectional view of the variable capacity water pump of FIG. 3 shown in a second position.
Figure 5:
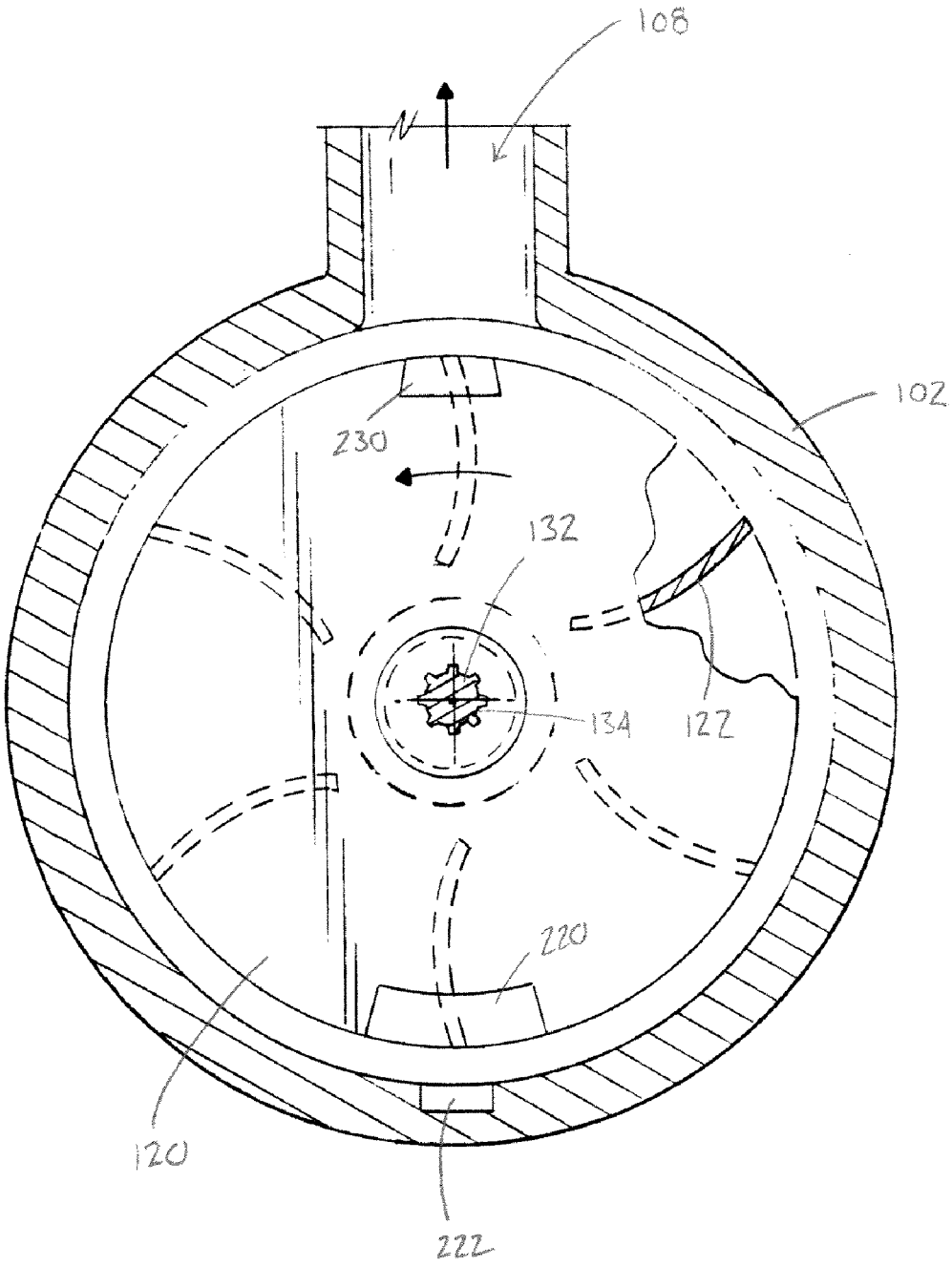
FIG. 5 is a cross-sectional view of the variable capacity water pump of FIG. 3 taken generally along line 5-5 of FIG. 3.

To alleviate the concern of the conventional fixed ratio water pump 24, the present disclosure provides a variable capacity water pump 100 having an electromagnetic control. Referring now to FIGS. 3-5, wherein like numerals refer to like parts throughout the several views, the water pump 100 comprises a pump housing 102, which defines a fluid chamber 104. The fluid chamber includes a fluid inlet 106 and a fluid outlet 108 for providing a flow of coolant through the housing 102. The water pump 100 further comprises an impeller 110 and an engine driven shaft 112 for supporting the impeller and rotating the impeller about a longitudinal axis.

The impeller 110 is rotationally supported in the fluid chamber 104 between the fluid inlet 106 and the fluid outlet 108 for pumping coolant through the housing 102. In the depicted embodiment, the impeller 110 is generally disk-shaped and includes a hub 118 and a flange 120 extending radially from the hub. At least two diametrically opposed vanes 122 project axially outward from the flange in the illustrated embodiment. As shown in FIG. 5, the depicted impeller includes six equally spaced vanes 122; although more or less than six vanes are contemplated as are other vane shapes and configurations.

The engine driven shaft 112 is disposed longitudinally within the housing 102. The shaft 112 includes a first end section 130 and a second end section 132 axially spaced from the first end section. The first end section 130 projects outwardly from the housing 102. The second end section 132 extends through a fluid chamber opening 136 and is at least partially disposed within the fluid chamber 104. A seal 138 prevents coolant from exiting the fluid chamber 104 through the opening 136 at the impeller shaft 112. As shown in FIGS. 3 and 4, the shaft first end section 130 has a first dimension and the shaft second end section 132 has a second, smaller dimension. Although, it should be appreciated that the drive shaft 112 can have a constant dimension.

The impeller 110 is rotatably coupled to the shaft 112 for co-rotation therewith. Particularly, the shaft second end section 132 has a non-round cross-sectional shape. As shown in FIG. 5, the second end section 132 is splined; although, alternative shapes, such as polygonal shaped, are contemplated. To secure the impeller 110 onto the shaft 112, the hub 118 includes a channel 134 extending through the hub. The channel 134 is shaped to matingly engage the shaft second end section 132. As will be discussed in greater detail below, the non-round shape of the second end section and corresponding channel allows the impeller 110 to be continuously engaged by the second end section 132 as the impeller is axially displaced along the second end section. A stop 136 is located on the second end section to secure the impeller 110 on the shaft.

The shaft 112 is drivable by a water pump pulley 140 which is belt driven from the engine crankshaft (not shown) at a rate proportional to a given engine speed. Particularly, a belt (such as belt 52, see FIG. 1) is coupled to a threaded region 142 of the water pump pulley 140. The water pump pulley 140 is connected to the shaft 112. The belt is also is coupled to the crankshaft of the engine by a crankshaft pulley (not shown). Thus, as the engine transmits torque to the crankshaft, the belt is rotated, which in turn rotates the water pump pulley 140, which in turn rotates the shaft 112 and impeller 110. Spaced apart bearings 150 and 152 support the shaft 112 within the housing 102. Bearing 152 is located adjacent the seal 138 in the fluid chamber opening 136; although, this is not required.

To provide good coolant flow at low engine idle speeds while avoiding pump cavitation at higher engine speeds, an electromagnetic field generator 160 is operably connected to the water pump, specifically to the shaft 112. In the depicted embodiment, the pump housing 102 defines second chamber 170, which is spaced from the fluid chamber 104, for housing the electromagnetic field generator; although, this is not required. The electromagnetic field generator 160 selectively produces a magnetic field that moves the impeller 110 axially along the shaft 112 between a first position (FIG. 3) for allowing a first amount of coolant flow through the housing 102 between the fluid inlet 106 and the fluid outlet 108 and a second position (FIG. 4) for selectively changing the amount of coolant flow through the housing.

The electromagnetic field generator 160 includes a stator 172 having a first set of electrically interconnected conductors or windings 174, and a rotor 180 having a second set of electrically interconnected conductors or windings 182. The series of conductors 174 and 182 are formed of a nonmagnetic, electrically conductive material. The conductors 174 are electrically coupled to one another, thereby forming one or more closed electrical pathways. Similarly, the conductors 182 are electrically coupled to one another, thereby forming one or more closed electrical pathways. The stator 122 can be an annular stator and is secured to a wall 184 of the housing 102. The rotor 180 is supported on the shaft 112 for co-rotation therewith. The rotor 180 can comprise a core formed of a series of magnetically conductive laminations arranged to form a lamination stack capped at each end by electrically conductive end rings. At least one rotor conductor 182 can wind around a portion of the shaft 112. In the depicted embodiment, separate conductors or windings 188, which are in series or electrically connected to the rotor conductors, are located on the shaft 112. A spool 190, on which the conductors 188 are wound, is mounted to the shaft 112 between the rotor 180 and the impeller 110.

As indicated previously, the electromagnetic field generator 160 produces a magnetic field that moves the impeller 110 away from the fluid inlet 106 toward the electromagnetic field generator to selectively change the amount of coolant flow through the fluid chamber 104. To generate the magnetic field, the stator conductors 172 are electrically stimulated. This electrical stimulation induces a magnet field which, in turn, induces an electrical current in the rotor conductors 182. The rotor conductors are in series with the spool conductors 188 which allows the electric field in the rotor conductors to pass through the spool conductors and generate the magnetic field. The conductors 188 wound on the spool 190 allow the magnetic field to be located in close proximity to the impeller 110, which is at least partially made of a ferrous material or connected to a ferrous material. This allows the rotating impeller to move axially on the shaft 112 from the first position (FIG. 3) toward the second position (FIG. 4) within the fluid chamber 104. It should be appreciated that the shaft 112 can be at least partially made of a ferrous material. In that instance, the electrical current in one of the rotor conductors 182 and the spool conductors 188 can magnetize the drive shaft 112. The spool conductors and the magnetized shaft act as an electromagnet which draws the impeller 110 towards the magnetic field.

An electronic control unit or controller 200 is electronically connected to the electromagnetic field generator 160 for controlling excitation of the stator windings 182. The controller 200 is in communication with at least one vehicle input sensor 202. The vehicle input sensor 202 sends a signal to the controller from which the controller controls the amount of excitation of the stator windings 172 as a function of many different automotive input signals obtained from the vehicle input sensor. A non-exhaustive list of potential input signals includes cylinder head temperature signals, fuel injection timing signals, and heater demand signals. In alternative embodiments, the controller 200 may also be coupled to a cooling fan and coolant valve in addition to electromagnetic field generator 160 and vehicle input sensor 202 to further optimize fuel economy and emissions. Moreover, in other alternative embodiments, the control of electrical excitation of the stator windings 172 may be controlled via a thermal switch coupled within an engine or cooling system component.

The impeller 110 is initially held in place against the stop 136 by a biasing member 210. The biasing member 210 urges the impeller 110 toward the first position (FIG. 3). Particularly, the biasing member exerts a torsional force, which opposes the magnetic field generated by the electromagnetic field generator 160. In the depicted embodiment, the biasing member is a spring supported on the second send section 132 of the shaft 112 and in contact with the hub 118 of the impeller. The spring 140 is connected between the impeller 110 and the larger first end section 130 of the drive shaft.

With continued reference to FIGS. 3 and 4, to determine the axial position of the impeller 110 within the fluid chamber 104, an indicant 220 is provided on the the impeller. A sensor 222 is coupled to the pump housing 102 and electrically connected to the controller 200 for detecting the indicant. In this embodiment, the indicant is a magnet supported on the flange 120 and the sensor is a Hall effect sensor. The magnet has a predetermined magnetic field so that a distance of the magnet from the Hall effect sensor 222 can be determined. Although, it should be appreciated that alternative manners for detecting the axial position of the impeller within the fluid chamber are contemplated. For example, the sensor can be an LED beam, a capacitive sensor, or the like. Based on the signals from the sensor 222 and the input sensor 202, the controller 200 can control the strength of the generated magnetic field. The impeller 110 can further include a mass balance weight 230, such as an iron slug, diametrically opposed from the magnet 220 to maintain dynamic balance of the impeller.

The present disclosure provides a method for controlling the flow rate of engine coolant through a cooling system to improve fuel economy and reduce emissions at a given engine speed. In the method, the water pump 100, including the housing 102 defining the fluid chamber 104, the impeller 110 disposed within the fluid chamber, and the engine driven drive shaft 112 extending axially through the water pump for rotating the impeller at a rate proportional to a given engine speed, is provided. The electromagnetic field generator 160 is coupled to the water pump. The electromagnetic field generator includes the annular stator 172 having the first set of electrically interconnected conductors 174 and the rotor 180 having the second set of electrically interconnected conductors 182. An electric current is introduced to the electromagnetic field generator to generate a magnetic field. The amount of electrical current introduced to the electromagnetic field generator is a function of the given engine speed to control the intensity of the magnetic field. The magnetic field is introduced within the water pump 100. The impeller 110 moves toward the magnetic field to selectively change the amount of coolant flow through the water pump at the given engine speed.

The method further includes coupling at least one vehicle input sensor 202 to the controller 200. The at least one input sensor is capable of sending an electronic signal to the controller. The controller 200 processes the input signal and introduces the electrical current to the electromagnetic field generator 160 as a function of the input signal and the given engine speed to control the intensity and timing of the magnetic field. To achieve a powerful and efficient magnetic field in the electromagnet, a direct current (DC) may be used. To generate the direct current in the conductors 188 wound on the spool 190, an alternating current (AC) signal may be necessary in the stator 172. The sensor will allow the controller 200 to modulate the alternating current in the stator windings 174 to maintain a direct current signal in the rotor windings 182 and finally the spool windings 188.

The present disclosure offers many advantages over currently available cooling systems. The capacity of the water pump 100 is controlled independent of a given engine speed and electronically to provide adequate coolant flow under various circumstances. When the engine is first turned on, at a point where the engine temperature is measured by temperature sensors to be cool, the impeller 110 is maintained in the first position (FIG. 3) to allow engine coolant to flow through the cooling system at a rate proportional to the given engine speed. This allows the engine to warm up as quickly as possible to its preferred engine temperature range, wherein fuel economy and emissions are idealized. Therefore, when the electromagnetic field generator 160 is not actuated, the water pump 100 operates as a conventional, engine driven mechanical water pump. As the engine warms up to acceptable levels, as sensed by various engine temperature sensors, the amount of coolant flow through the cooling system can be varied by actuating the electromagnetic field generator 160 and causing the impeller 110 to move towards its second position (FIG. 4). Particularly, as an electrical current is applied to the stator conductors 174, an electrical current is induced in the rotor conductors 182. As electrical current flows through the rotor conductors 182 and the spool windings 188, a magnetic field is generated. Further, the current passing through the spool windings can create an electromagnet in the shaft 112. The magnet field, in the direction of the rotor shown in the figures, pulls on the impeller 110, compressing the spring 210, and changing the coolant flow rate. It should be appreciated that the coolant flow rate depends on the axial position of the impeller. As the impeller 110 movers on the shaft 112 from the first position towards the second position (the movement depending of the intensity and timing of the magnetic field) and back to the first position (via the spring 210), the coolant flow rate will vary. The desired result is to reduce the torque necessary to spin the rotor/water pump. The change of flow rate can be used to achieve improved fuel economy.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A variable flow coolant pump for an engine of a motor vehicle comprising:

a pump housing defining a fluid chamber, the fluid chamber including a fluid inlet and a fluid outlet for providing flow of coolant through the housing;

an impeller rotationally supported in the fluid chamber between the inlet and the outlet for pumping coolant through the housing;

an engine driven shaft disposed within the housing for supporting the impeller and rotating the impeller about a longitudinal axis; and an electromagnetic field generator selectively producing a magnetic field that moves the impeller axially along the shaft between a first position and a second position for selectively changing the amount of coolant flow through the housing between the fluid inlet and the fluid outlet.

2. The coolant pump of claim 1, wherein the pump housing defines a second chamber for housing the electromagnetic field generator.

3. The coolant pump of claim 1, wherein the electromagnetic field generator includes a stator having a first set of electrically interconnected conductors, and a rotor having a second set of electrically interconnected conductors, wherein electrical stimulation of the first set of conductors induces an electrical current in the second set of conductors which generates the magnetic field causing the impeller to move from the first position toward the second position within the fluid chamber.

4. The coolant pump of claim 3, wherein the rotor is supported on the shaft and at least one conductor of the second set of conductors winds around a portion of the shaft.

5. The coolant pump of claim 3, further including a spool rotatably supported on the shaft, the spool being spaced from the rotor toward the impeller, the spool including conductors, the spool conductors being in series with the second set of conductors.

6. The coolant pump of claim 3, further comprising:

a controller electronically connected to the electromagnetic field generator for controlling excitation of the first set of windings, wherein the controller is in communication with at least one vehicle input sensor, the at least one vehicle input sensor sending a signal to the controller from which the controller controls the amount of excitation of the first set of windings.

7. The coolant pump of claim 3, further comprising a biasing member for urging the impeller toward the first position.

8. The coolant pump of claim 1, wherein the shaft includes a first end section for supporting the electromagnetic field generator and a second end section axially spaced from the first end section and at least partially disposed within the fluid chamber, the first end section having a first dimension and the second end section having a second, smaller dimension, wherein the impeller is rotatably coupled to the shaft for co-rotation therewith, wherein the impeller is continuously engaged by the second end section as the impeller is axially displaced along the second end section.

9. The coolant pump of claim 1, wherein the impeller includes an indicant and further comprising a sensor coupled to the pump housing for detecting the axial position of the indicant within the fluid chamber.

10. The coolant pump of claim 9, wherein the indicant is a magnet and the impeller includes a mass balance weight diametrically opposed from the magnet to maintain dynamic balance of the impeller.

11. The coolant pump of claim 1, further comprising a water pump pulley coupled to an end section of the shaft, the water pump pulley being driven by a drive belt at a rate proportional to a given engine speed.

12. The coolant pump of claim 1, wherein the shaft and the impeller are at least partially formed of a ferrous metal.

13. A water pump for use in a coolant system to cool an engine comprising:

a housing defining a fluid chamber having a fluid inlet and a fluid outlet;

a drive shaft having a first end section connected to an engine driven water pump pulley and a second end section, the drive shaft rotating at a rate proportional to a given engine speed;

an impeller disposed within the fluid chamber and coupled to the second end section of the drive shaft, the impeller pumping coolant through the housing and to the engine when rotated; and an electromagnetic field generator operatively engaged to the drive shaft, the electromagnetic field generator producing a magnetic field that moves the impeller away from the fluid inlet to selectively change the amount of coolant flow through the fluid chamber.

14. The water pump of claim 13, further comprising an electronic control unit coupled to the electromagnetic field generator, the electronic control unit electrically stimulating the electromagnetic field generator to produce the magnetic field, the electronic control unit controlling the amount of electrical stimulation sent to the electromagnetic field generator at the given engine speed.

15. The water pump of claim 14, further comprising a sensor mounted within the fluid chamber for monitoring an axial position of the impeller within the fluid chamber, the sensor being electronically connected to the electronic control unit.

16. The water pump of claim 15, wherein the sensor is a Hall effect sensor and the impeller includes a magnet having a predetermined magnetic field so that a distance of the magnet from the Hall effect sensor is determined.

17. The water pump of claim 14, wherein the electromagnetic field generator includes an annular stator having a first set of electrically interconnected windings, and a rotor having a second set of electrically interconnected windings, the second set of windings winding about a portion of the drive shaft, the rotor being rotatably coupled to the drive shaft for co-rotation therewith, wherein electrical stimulation of the first set of windings induces an electrical current in the second set of windings which magnetizes the drive shaft for generating the magnetic field.

18. The water pump of claim 13, further comprising a biasing member supported on the second end section of the drive shaft and in contact with the impeller for urging the impeller toward the fluid inlet.

19. A method for controlling the flow rate of engine coolant through a cooling system, the method comprising:

providing a water pump, the water pump including a housing defining a fluid chamber, the water pump including an impeller disposed within the fluid chamber and an engine driven drive shaft extending axially through the water pump for rotating the impeller at a rate proportional to a given engine speed;

coupling an electromagnetic field generator to the water pump, the electromagnetic field generator including an annular stator having a first set of electrically interconnected conductors and a rotor having a second set of electrically interconnected conductors;

introducing an electric current to the electromagnetic field generator to generate a magnetic field, the amount of electrical current introduced to the electromagnetic field generator being a function of the given engine speed to control the intensity and timing of the magnetic field; and introducing the magnetic field within the water pump, wherein the impeller moves toward the magnetic field to selectively change the amount of coolant flow through the water pump at the given engine speed.

20. The method of claim 19, further comprising:

winding a portion of the shaft with at least one conductor, the at least one conductor being electrically connected to the second set of conductors, and introducing an electrical current to the first set of conductors, wherein the electrical charge induces an electrical current in the second set of conductors and the at least one conductor which induces a magnetic field around the shaft in response to the electrical current, wherein the amount of the electrical current introduced to the first set of conductors is proportional to the amount of the magnetic field induced.

21. The method of claim 19, further comprising magnetizing the drive shaft to generate the magnetic field.

* * * * *